US005219132A

United States Patent [19]

Beckerleg et al.

[11] Patent Number: 5,219,132

[45] Date of Patent: Jun. 15, 1993

[54] TWO-AXIS GIMBAL ARRANGEMENT

[75] Inventors: Richard A. Beckerleg, Boxford; Richard R. LaTorre, Bedford; Barry N. Levitt, Framingham, all of Mass.

[73] Assignee: Raytheon Company, Lexington, Mass.

[21] Appl. No.: 356,700

[22] Filed: Mar. 3, 1982

[51] Int. Cl.[5] ..... F41G 7/26

[52] U.S. Cl. ..... 244/3.16

[58] Field of Search ..... 244/3.16

[56] References Cited

U.S. PATENT DOCUMENTS 2,963,973 12/1960 Estey ..... 244/3.16
3,729,172 4/1973 Stephenson ..... 244/3.16
4,009,848 3/1977 Albert et al. ..... 244/3.16
4,039,246 8/1977 Voigt ..... 244/3.16
4,155,521 5/1979 Evans et al. ..... 244/3.16
4,168,813 9/1979 Pinson et al. ..... 244/3.16

*Primary Examiner*—Charles T. Jordan
*Attorney, Agent, or Firm*—Donald F. Mofford; Richard M. Sharkansky

[57] ABSTRACT

A gyroscopically stabilized optical seeker for use in a cannon-launched projectile is shown to include a gimbal arrangement wherein a two-axis rate gyroscope and associated torque motors are utilized to attain the requisite stabilization however such seeker is oriented with respect to such projectile, the two-axis rate gyroscope being arranged so that the complete optical system, including the detector unit, may be mounted on the inner gimbal.

3 Claims, 2 Drawing Sheets

TWO-AXIS GIMBAL ARRANGEMENT

BACKGROUND OF THE INVENTION

This invention pertains generally to optical seekers, and more particularly to seekers of such type having improved resolution characteristics through extended ranges of gimbal angles.

The numerical advantages in armored vehicles enjoyed by potential enemy forces and the concomitant threat of a massive armor attack has led to the development of so-called "smart" anti-armor projectiles that are capable of distinguishing between targets and are then automatically guided to a selected target. One known type of smart projectile, incorporating an infrared (IR) seeker, is launched from a cannon or howitzer removed from the forward edge of the battle area. In the terminal phase of the flight of such a projectile the IR seeker searches for, and acquires, a single target even though countermeasures may have been taken by the enemy. Obviously, then, the IR seeker must be adapted (i.e. "g-hardened") to survive the large acceleration (the high-g environment) associated with launching from a cannon.

One known type of g-hardened IR seeker, generally referred to as an optical "free gyro" (meaning free gyroscope) seeker, employs a hard coated spherical gas bearing to survive the high-g environment at launch. While the hard coated spherical gas bearing enables the optical free gyro seeker to survive high-g loads, it restricts the gimbal angle freedom to 15 degrees, thereby unduly limiting the field of view of the seeker. Furthermore, in such a seeker the refrigerated detector unit is "body-fixed" (meaning it moves relative to its associated mirrors or lenses) with the result that resolution is degraded as the gimbal angle is increased.

Obviously, in a stand-off weapon system the effects of ballistic dispersion as well as other environmental conditions, as, for example, wind and rain, will have an adverse impact on the circular error of probability (CEP) of the system. It follows, therefore, that the effectiveness of such a stand-off weapon system will be enhanced if the total field of view and resolution of the projectile seeker are augmented to permit the search for and acquisition of targets over a broader area.

SUMMARY OF THE INVENTION

With this background of the invention in mind it is therefore an object of this invention to provide a g-hardened IR seeker having an improved field of view.

It is another object of this invention to provide a g-hardened IR seeker having improved optical resolution.

These and other objects of this invention are generally attained by providing a g-hardened IR seeker wherein a g-hardened two-axis rate gyro is utilized for platform stabilization. The g-hardened two-axis rate gyro is an annular device, thereby allowing part of the optical system to be mounted within it. Mounting a portion of the optical system within the g-hardened two-axis rate gyro reduces the overall length of the seeker head, thereby allowing 30 degree gimbal angles to be realized. Small diameter journal bearings are provided on each of the gimbal axes to survive the high-g loads. Additional length reduction is achieved by modifying the conventional gimbal assembly by using the projectile housing itself as the pedestal. Diametrically opposed D.C. torque motors provided on the inner gimbal axis drive the inner gimbal with respect to the outer gimbal. The outer gimbal is driven with respect to the projectile body by means of a D.C. servo torque motor. The motor axis of the D.C. servo torque motor is concentric to the projectile axis and the outer gimbal is driven through a step-up miter or bevel gear train. The inner gimbal houses the optical system, the detector unit, and the high-g two-degree of freedom rate gyro. Because the optics and the detector unit move with the inner gimbal, the degradation of optical resolution with gimbal angle is avoided.

BRIEF DESCRIPTION OF THE DRAWINGS

For a more complete understanding of this invention, reference is now made to the following description of the accompanying drawings, wherein.

DESCRIPTION OF THE PREFERRED EMBODIMENT

Figure 1:
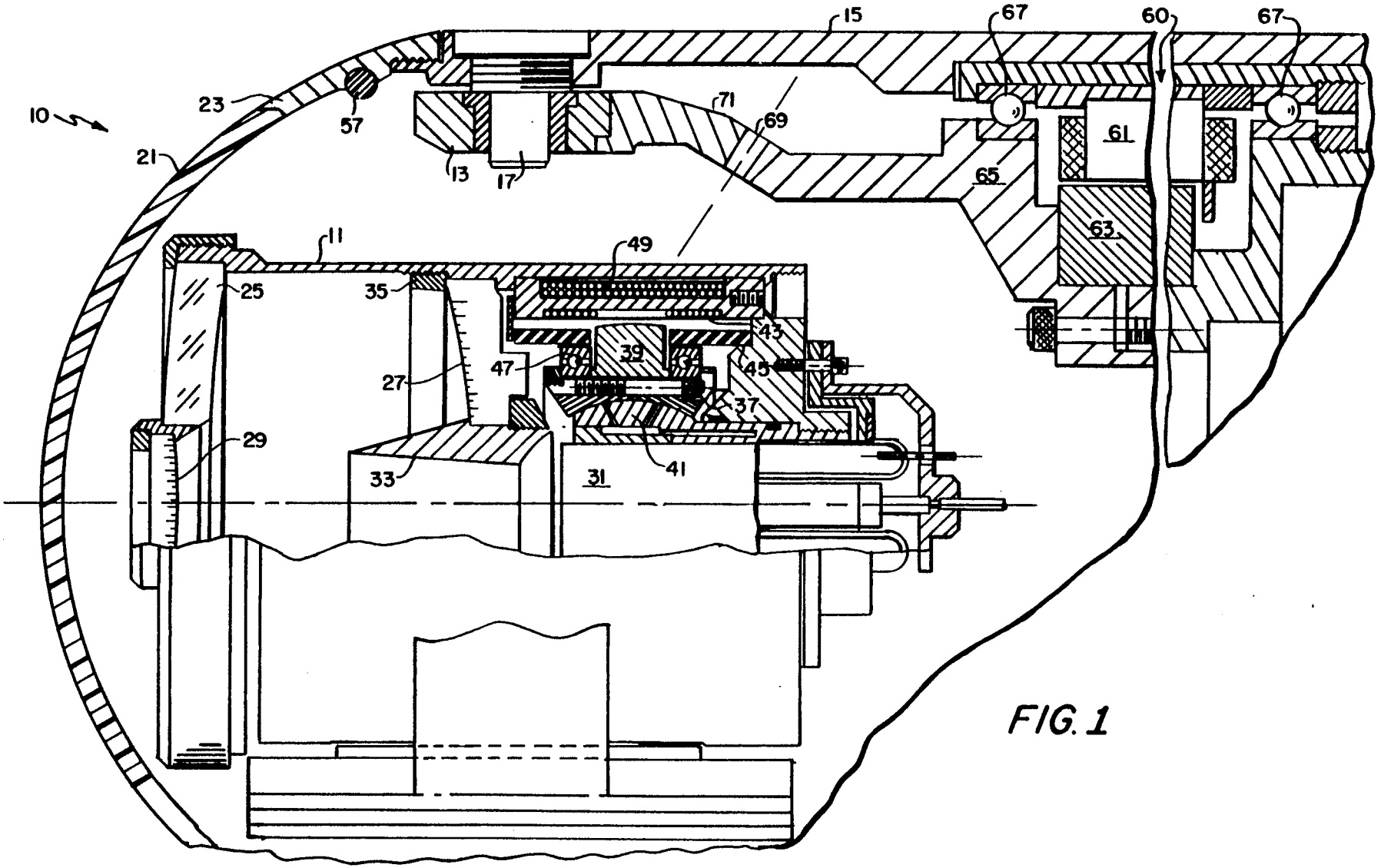
FIG. 1 is a partial cross-sectional view of a g-hardened IR seeker according to this invention.
Figure 2:
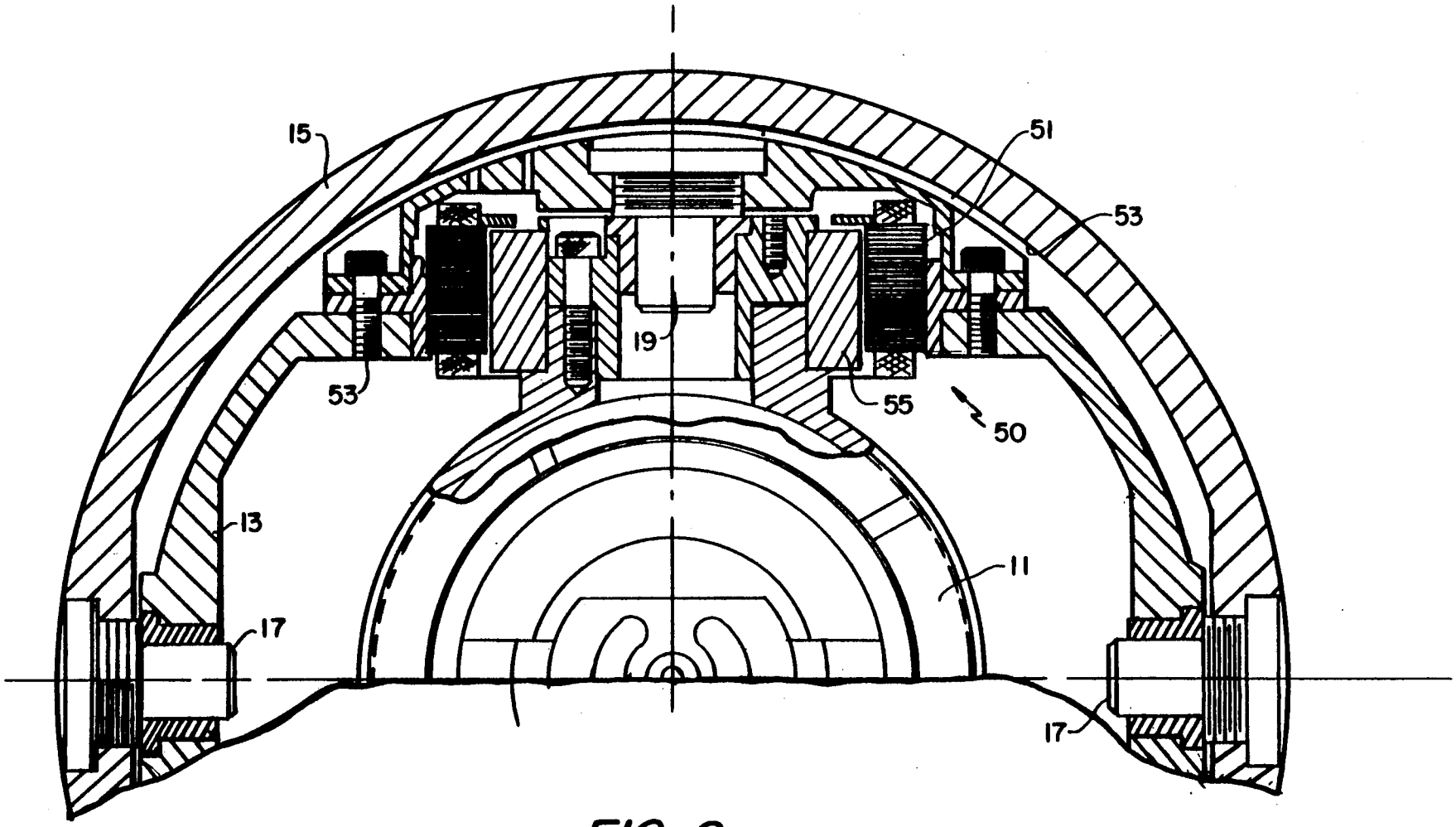
FIG. 2 is a partial rear view of the g-hardened IR seeker of FIG. 1 but rotated 90° with respect to FIG. 1.

Referring now to FIGS. 1 and 2, a g-hardened IR seeker 10 according to this invention is shown to include an inner gimbal 11 and an outer gimbal 13. The latter is affixed to the projectile body 15 by means of a pair of journal bearings 17 and the inner gimbal 11 is attached to the outer gimbal 13 by means of journal bearings 19. The journal bearings 17, 19 enable the outer gimbal 13 and the inner gimbal 11, respectively, to survive the high-g cannon launch environment. A zinc sulfide IR dome 21 is bonded, in any convenient manner, to a mounting ring 23 which is threaded onto the projectile body 15.

A catadioptric optical system (not numbered), including a zinc sulfide corrector lens 25, a primary mirror 27, a secondary mirror 29, and a refrigerated detector unit (RDU) 31, is mounted within the inner gimbal 11. The primary mirror 27 is supported in the inner gimbal 11 and is restrained by a ring 35. The light shield 33 prevents sunlight or other extraneous energy from entering the RDU 31.

Also packaged within the inner gimbal 11 is a two-degree of freedom rate gyro (not numbered). The latter includes a motor rotor 37, having a permanent magnet 39 affixed thereto, and a stator 41. The rotor 37 and the stator 41 have complementary spherical surfaces to form a kind of universal joint. Pressurized gas from a source (not shown) is forced between the complementary spherical surfaces in a conventional manner, here through ports (not numbered), to form a hydrostatic gas bearing. The RDU 31 is contained within the stator 41 which is affixed to the inner gimbal 11. The permanent magnet 39 reacts with motor rotating coils 43 in a conventional manner so that the rotor 37 forms a gyroscopic mass whose spin axis is coincided with the longitudinal axis of the projectile body 15. The rotor 37 is spring-restrained via a spring mechanism 45 disposed between the rotor 37 and the inner gimbal housing 11. Spring decoupling bearings 47 are provided to isolate the spring mechanism 45 from the spin of the rotor 37. It will be appreciated that the spinning rotor 37 acts as an elastically restrained gyroscopic mass and therefore any angular rotation of the gyroscopic mass about its input axis, which is orthogonal to the spin axis and is in the plane of the paper, will ultimately cause a precessional movement of the rotor 37. A precessional movement of the rotor 37 appears as a rotational movement of the rotor 37 about the output axis of the two-degree of freedom rate gyro (not numbered), which is mutually orthogonal to both the spin axis and the input axis. Two axes orthogonal to each other and to the spin axis act simultaneously as input and output axes for the two-degree of freedom rate gyro (not numbered). Angle sensing coils 49 are provided to sense the position of the rotor 37 in a conventional manner.

As mentioned briefly hereinabove, the inner gimbal 11 is supported on journal bearings 19 and is driven by a pair of D.C. torque motors 50, only one of which is shown, located on opposite sides of the inner gimbal axis. The stator 51 of the torque motor 50 is affixed to the outer gimbal 13 by means of screws 53, while the rotor 55 is coupled to the inner gimbal 11. The D.C. torque motors 50 will drive the inner gimbal 11 through a gimbal angle of ±30 degrees with respect to the outer gimbal 13. An annular gimbal stop 57 is provided on the inner surface of the mounting ring 23 to engage the inner gimbal 11 at its limits.

It should be noted here in passing that as the catadioptric optical system (not numbered) and the RDU 31 are housed within the inner gimbal 11 there is no degradation in resolution with gimbal angle.

The outer gimbal 13 carries or supports the inner gimbal 11 and is driven with respect to the projectile body 15 by a D.C. servo torque motor 60 that is mounted to the projectile body 15 concentric with the projectile axis. The motor stator 61 is secured to the projectile body 15. The motor rotor 63 has attached thereto a shaft 65. Bearings 67 are provided to enable the shaft 65 and the rotor 63 to rotate relative to the projectile body 15. The other end of the shaft 65 has an angular bevel gear 69 provided thereon which engages a corresponding gear 71 provided on the outer gimbal 13. Thus, the latter is controlled by command signals applied to the D.C. servo torque motor 60 which causes the shaft 65 to rotate with respect to the projectile body 15 and results in the outer gimbal 13 being gimballed about the journal bearing 17.

It should be recognized that although the inner gimbal 11 and the outer gimbal 13 are mounted on journal bearings 17, 19, respectively, for the purposes of g-hardening, the spin decoupling bearings 47 and the bearings 67 are both ball bearings. The use of such ball bearings does not compromise the g-hardening as the loads that both the spin decoupling bearings 47 and the bearings 67 support are minimal.

Having described a preferred embodiment of this invention, it will now be apparent to those of skill in the art that many modifications may be made without departing from our inventive concepts. Thus, for example, although a catadioptric optical system was described, a refractive optical system could just as well be utilized without departing from our novel concept of utilizing a "see through" g-hardened two degree of freedom rate gyro that allows the optical system to pass directly through it. It is felt, therefore, that this invention should not be restricted to its disclosed embodiment, but rather should be limited only by the spirit and scope of the appended claims.

What is claimed is:

1. In an infrared seeker for use in a cannon-launched projectile, such seeker including an optical arrangement for focusing infrared energy from targets on a detection unit, an improved gimballing and stabilizing arrangement comprising:

(a) an outer gimbal rotatably mounted on the body of such projectile to rotate about a first line orthogonal to the longitudinal axis of such projectile, such outer gimbal being shaped substantially in the shape of a ring;

(b) an inner gimbal rotatably mounted on the outer gimbal to rotate about a second line orthogonal to the first line, such inner gimbal being substantially shaped in the shape of a hollow cylinder;

(c) a base member affixed to such hollow cylinder to cover one open end thereof;

(d) an infrared sensor disposed within the hollow cylinder and affixed to the base member, the outer surface of such sensor and a corresponding portion of the inner surface of such cylinder forming an annular space;

(e) a spherical bearing affixed to the outer surface of the infrared sensor in the annular space;

(f) a rotor of an electric motor mounted on the spherical bearing to form a gyroscopic mass;

(g) a stator of the electric motor mounted on the inside of the hollow cylinder;

(h) resilient restraining means, disposed between the rotor and the inner surface of the hollow cylinder, for providing a restoring torque to the rotor; and (i) sensing means attached to the inner surface of the hollow cylinder for providing a signal representative of the orientation of the rotor on the spherical bearing.

2. The improved arrangement as in claim 1 having, additionally, torquer means cooperating with the inner and outer gimbals to orient the inner gimbal with respect to the longitudinal axis of the cannon-launched projectile.

3. The improvement as in claim 2 having, additionally, means disposed in the open end of the hollow cylinder for focusing infrared energy on the infrared sensor.

* * * * *